US005636845A

United States Patent [19]

Newnam

[11] Patent Number: 5,636,845

[45] Date of Patent: Jun. 10, 1997

[54] ARCHERY ARROW

[76] Inventor: James V. Newnam, 511 Johnson St., West Plains, Mo. 65775

[21] Appl. No.: 368,894

[22] Filed: Jan. 5, 1995

[51] Int. Cl.[6] ..... F42B 6/08

[52] U.S. Cl. ..... 473/583; 30/344; 30/353

[58] Field of Search ..... 273/419, 420, 273/416, 421, 422; 30/344, 353

[56] References Cited

U.S. PATENT DOCUMENTS

| | | | |
|---|---|---|---|
| D. 247,504 | 3/1978 | Trinkle | D22/115 |
| D. 314,416 | 2/1991 | Rezmer . | |
| 1,040,138 | 10/1912 | Buck | 30/353 X |
| 1,778,773 | 10/1930 | Reynolds | 30/353 X |
| 2,265,564 | 12/1941 | Klopsteg | 273/421 X |
| 2,829,894 | 4/1958 | Henkel | 273/422 |
| 3,398,960 | 8/1968 | Carroll, Jr. | 273/419 X |
| 3,618,948 | 11/1971 | McGlocklin | 273/421 |
| 3,854,723 | 12/1974 | Wilson | 273/420 |
| 3,993,311 | 11/1976 | Johnson | 273/420 |
| 4,203,601 | 5/1980 | Simo | 273/421 |
| 4,341,391 | 7/1982 | Anderson | 273/422 |
| 4,468,038 | 8/1984 | Saunders . | |
| 4,537,404 | 8/1985 | Castellano et al. . | |
| 5,145,186 | 9/1992 | Maleski . | |
| 5,178,398 | 1/1993 | Eddy . | |

FOREIGN PATENT DOCUMENTS

| | | | |
|---|---|---|---|
| 2588648 | 4/1987 | France | 273/421 |
| 4869 | of 1892 | United Kingdom | 30/344 |
| 27734 | of 1910 | United Kingdom | 30/344 |

*Primary Examiner*—Paul E. Shapiro

[57] ABSTRACT

An arrow for piercing a target in both forward and reverse directions. The inventive device includes an arrowhead having a pair of angled leading edges for piercing a target upon impacting of the arrow therewith, and a pair of angled trailing edges which facilitate removal of the arrow from the target subsequent to impact. The arrow is secured to an elongated arrow shaft having a bifurcated leading end extending over the arrowhead by pins extending through both the arrow shaft and the arrowhead.

17 Claims, 3 Drawing Sheets

FIG. 3
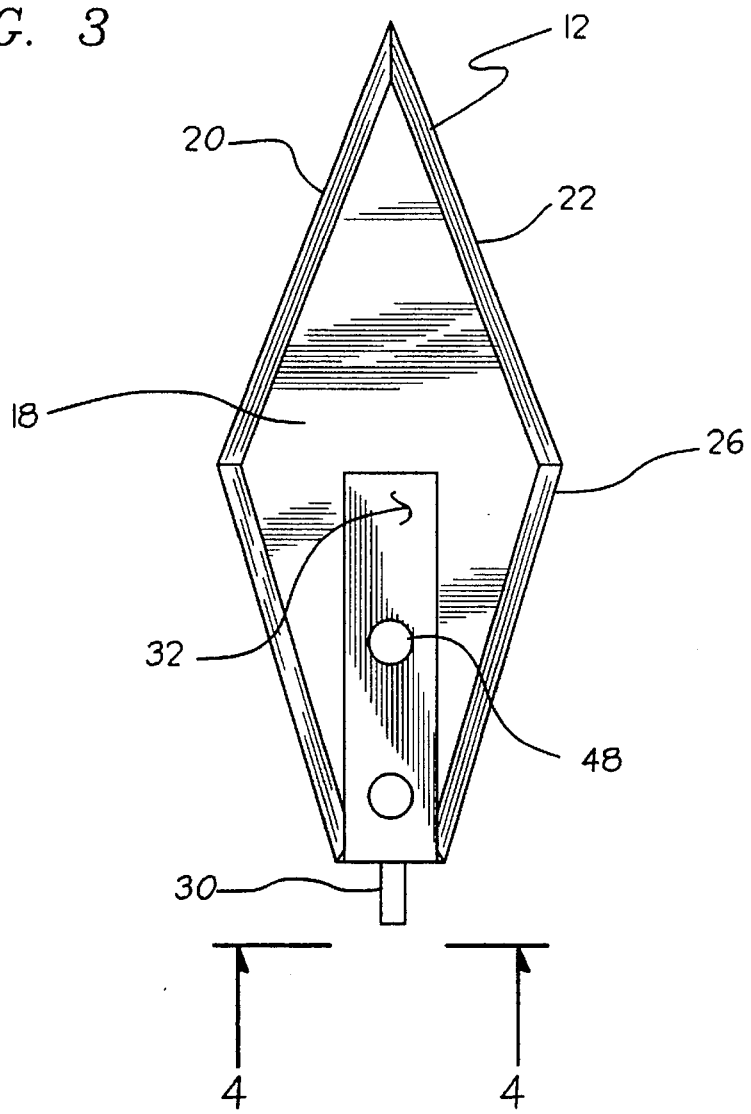
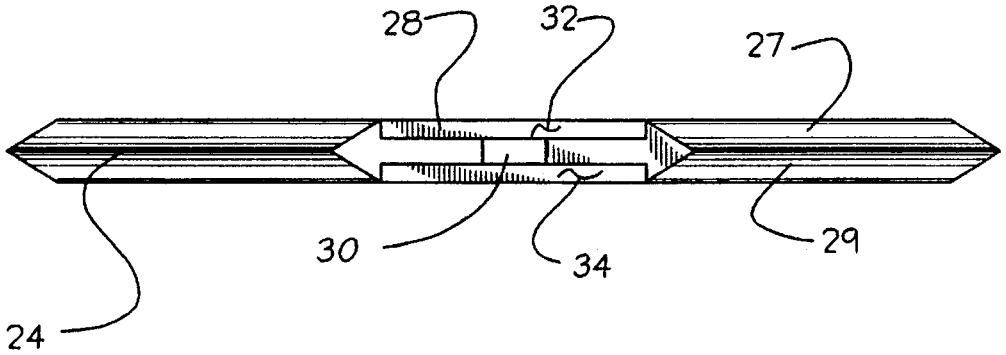
FIG. 4

ARCHERY ARROW

BACKGROUND OF THE INVENTION

1. Field of the Invention

The present invention relates to arrow structures and more particularly pertains to an arrow for piercing a target in both forward and reverse directions.

2. Description of the Prior Art

The use of arrow structures is known in the prior art. More specifically, arrow structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art arrow structures include U.S. Pat. No. 5,178,398; U.S. Pat. No. 5,145,186; U.S. Pat. No. 4,537,404; U.S. Pat. No. 4,468,038; and U.S. Pat. No. Des. 314,416.

While these devices fulfill their respective, particular objectives and requirements, the aforementioned patents do not disclose an arrow for piercing a target in both forward and reverse directions which includes an arrowhead having a pair of angled leading edges for piercing a target upon impacting of the arrow therewith and a pair of angled trailing edges which facilitate removal of the arrow from the target subsequent to impact, and an elongated arrow shaft having a bifurcated leading end extending partially over the arrowhead and being secured thereto by pins extending through both the arrow shaft and the arrowhead.

In these respects, the archery arrow according to the present invention substantially departs from the conventional concepts and designs of the prior art, and in so doing provides an apparatus primarily developed for the purpose of piercing a target in both forward and reverse directions.

SUMMARY OF THE INVENTION

In view of the foregoing disadvantages inherent in the known types of arrow structures now present in the prior art, the present invention provides a new archery arrow construction wherein the same can be utilized for piercing a target in both forward and reverse directions. As such, the general purpose of the present invention, which will be described subsequently in greater detail, is to provide a new archery arrow apparatus and method which has many of the advantages of the arrow structures mentioned heretofore and many novel features that result in a archery arrow which is not anticipated, rendered obvious, suggested, or even implied by any of the prior art arrow structures, either alone or in any combination thereof.

To attain this, the present invention generally comprises an arrow for piercing a target in both forward and reverse directions. The inventive device includes an arrowhead having a pair of angled leading edges for piercing a target upon impacting of the arrow therewith, and a pair of angled trailing edges which facilitate removal of the arrow from the target subsequent to impact. The arrow is secured to an elongated arrow shaft having a bifurcated leading end extending over the arrowhead by pins extending through both the arrow shaft and the arrowhead.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new archery arrow apparatus and method which has many of the advantages of the arrow structures mentioned heretofore and many novel features that result in a archery arrow which is not anticipated, rendered obvious, suggested, or even implied by any of the prior art arrow structures, either alone or in any combination thereof.

It is another object of the present invention to provide a new archery arrow which may be easily and efficiently manufactured and marketed.

It is a further object of the present invention to provide a new archery arrow which is of a durable and reliable construction.

An even further object of the present invention is to provide a new archery arrow which is susceptible of a low cost of manufacture with regard to both materials and labor, and which accordingly is then susceptible of low prices of sale to the consuming public, thereby making such archery arrows economically available to the buying public.

Still yet another object of the present invention is to provide a new archery arrow which provides in the apparatuses and methods of the prior art some of the advantages thereof, while simultaneously overcoming some of the disadvantages normally associated therewith.

Still another object of the present invention is to provide a new archery arrow for piercing a target in both forward and reverse directions.

Yet another object of the present invention is to provide a new archery arrow which includes an arrowhead having a pair of angled leading edges for piercing a target upon impacting of the arrow therewith and a pair of angled trailing edges which facilitate removal of the arrow from the target subsequent to impact, and an elongated arrow shaft having a bifurcated leading end extending partially over the arrowhead and being secured thereto by pins extending through both the arrow shaft and the arrowhead.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view of an arrowhead comprising a portion of the invention.

FIG. 4 is an end elevation view of the arrowhead.

DESCRIPTION OF THE PREFERRED EMBODIMENT

Figure 1:
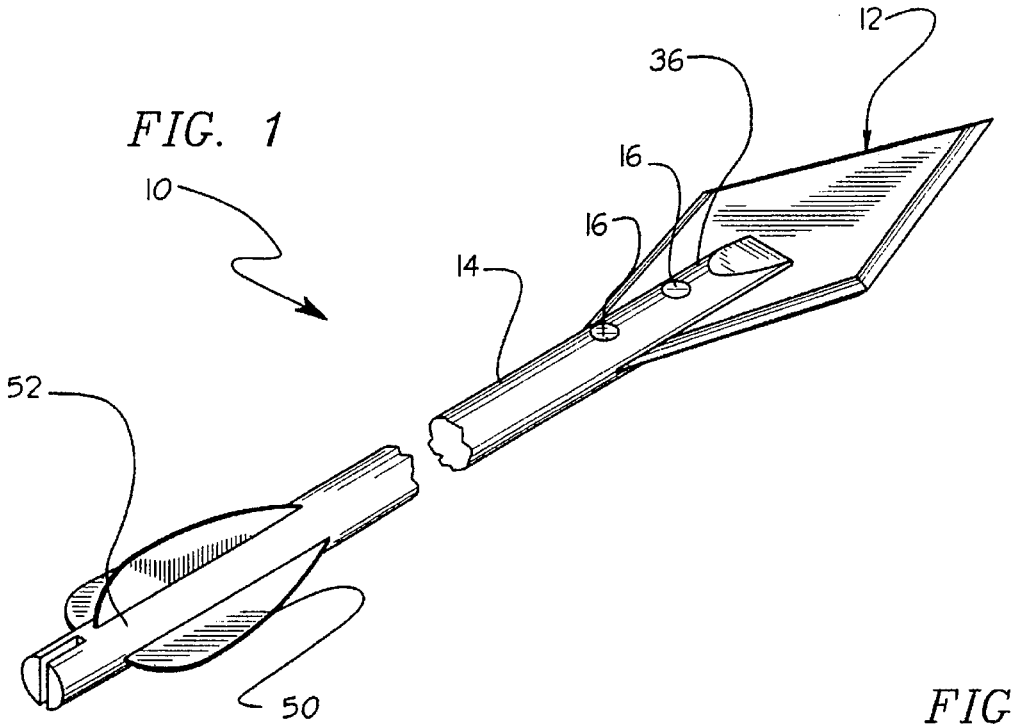
FIG. 1 is an isometric illustration of an archery arrow according to the present invention.

With reference now to the drawings, and in particular to FIGS. 1–6 thereof, a new archery arrow embodying the principles and concepts of the present invention and generally designated by the reference numeral 10 will be described.

Figure 2:
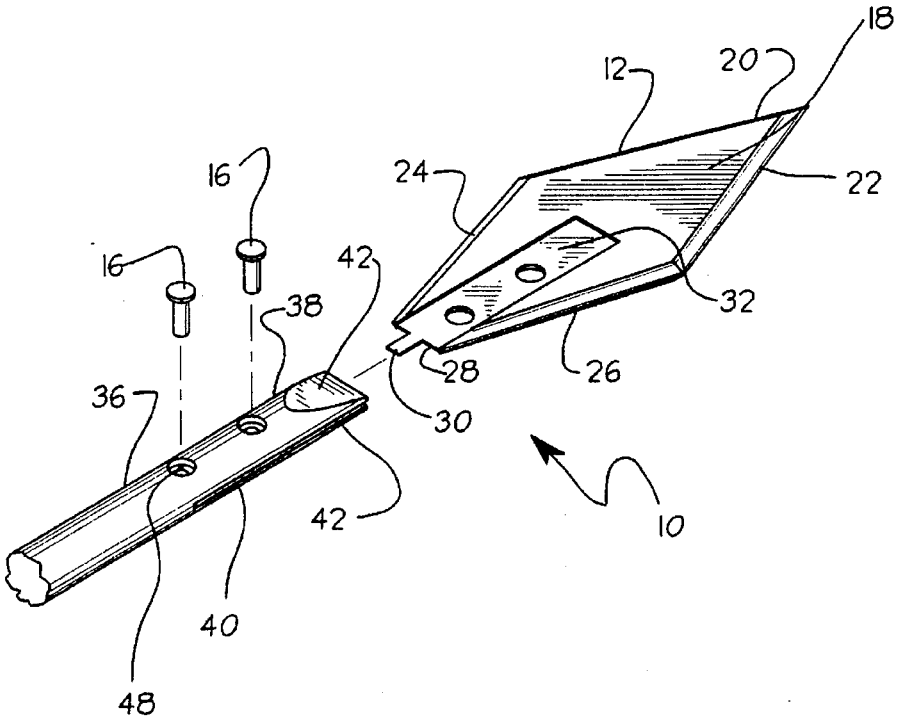
FIG. 2 is an exploded isometric view of the invention.

More specifically, it will be noted that the archery arrow 10 comprises an arrowhead 12 coupled to an elongated arrow shaft 14 by a pair of pins 16. As best illustrated in FIGS. 2 through 4, it can be shown that the arrowhead 12 comprises a planar member 18 shaped so as to define a first leading edge 20 and a second leading edge 22 oriented at a first oblique angle relative to one another. The planar member 18 is further shaped so as to define a first trailing edge 24 and a second trailing edge 26 oriented at a second oblique angle relative to one another. Preferably, the first oblique angle between the first leading edge 20 and the second leading edge 22 is substantially equal to the second oblique angle between the first trailing edge 24 and the second trailing edge 26 such that the arrowhead is symmetrically oriented about a longitudinal axis directed between the first edges 20 and 24 and the second edges 22 and 26. The first leading edge 20 is oriented at a third oblique angle relative to the first trailing edge 24, with the second leading edge 22 being oriented at a fourth oblique angle relative to the second trailing edge 26. Preferably, the third and fourth oblique angles are substantially equal, as shown in the drawings. To preclude wind planing of the arrow during flight, the third and fourth oblique angles are preferably substantially greater than the first and second oblique angles such that a longitudinal length of the arrowhead 12 is equal to approximately at least two and one half or three (2.5 or 3) times a transverse width of the arrowhead. As shown in FIG. 4, the edges 20–26 of the arrowhead 12 are sharpened by an upper bevel 27 extending about an upper perimeter of the planar member 18 which intersects a lower bevel 29 similarly extending about a lower perimeter of the planar member. By this structure, the leading edges 20 and 22 of the arrowhead 12 operate to piercingly engage a target, while the trailing edges 24 and 26 permit ease of removal of the arrowhead from such target. The arrowhead 12 may also be provided with a coating of a fluoropolymer such as the trademarked "TEFLON" to enhance piercability of the device 10.

Figure 5:
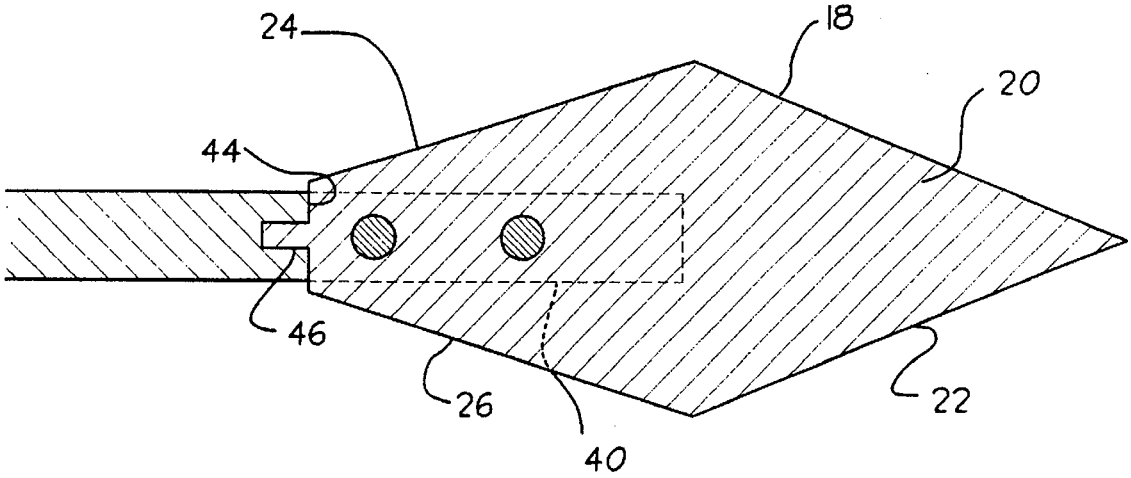
FIG. 5 is a cross sectional view of a portion of the invention.
Figure 6:
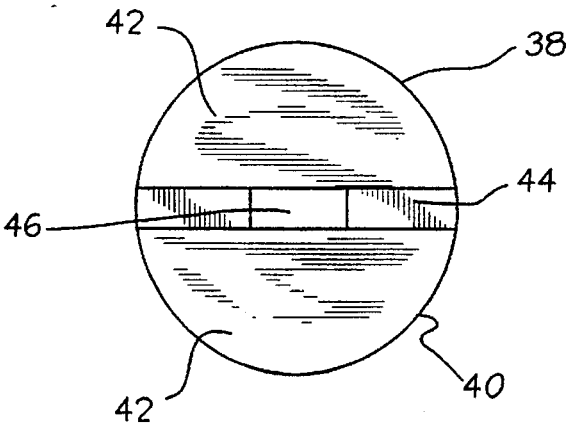
FIG. 6 is an end elevation view a bifurcated end of an arrow shaft of the invention.

To facilitate mounting of the arrowhead 12 to the arrow shaft 14, the planar member 18 is shaped so as to define a straight rear edge 28 intersecting the angled trailing edges 24 and 26. A projecting alignment tab 30 extends from the straight rear edge 28 for reception within the arrow shaft 14 in a manner which will subsequently be described in more detail. As illustrated in FIGS. 3 and 4, the planar member 18 of the arrowhead 12 is further shaped so as to define a substantially rectangular upper recess 32 extending along an upper surface thereof, with a substantially rectangular lower recess 34 extending along a lower surface of the planar member. The planar member 18 of the arrowhead is shaped such that the recesses 32 and 34 are coextensive relative to one another so as to receive the bifurcated leading end 36 of the elongated arrow shaft 14. As shown in FIGS. 2, 4, and 5, the bifurcated leading end 36 of the elongated arrow shaft 14 includes an upper furcation 38 and a lower furcation 40. The furcations 38 and 40 are shaped so as to define beveled leading edges 42 which enhance the aerodynamics of the assembly 10. The furcations 38 and 40 are coupled together by a straight rear wall 44 including an alignment notch 46 which receives the projecting alignment tab 30 of the arrowhead 12 when the same is positioned between the furcations 38 and 40. Mounting apertures 48 directed through both the bifurcated leading end 36 of the arrow shaft 14 and the planar member 18 of the arrowhead 12 permit a passage of the pins 16 therethrough to couple the arrowhead to the shaft. Preferably, an adhesive is also interposed between the arrowhead and the arrow shaft to further rigidify the assemblage 10. When assembled, the upper furcation 38 will reside within the upper recess 32 of the planar member 18 of the arrowhead 12, with the lower furcation 40 residing within the lower recess 34. The recesses 32 and 34 are desirably shaped such that the perimeter edges of the recesses abuttingly engage the perimeter edges of the respective furcations 38 and 40. Such abutting engagement of the perimeter edges of these components 32, 34 and 38, 40 serves to preclude rotating movement of the arrowhead 12 relative to the arrow shaft 14. Further, the alignment tab 30, when positioned within the alignment notch 46 of the arrow shaft 14 serves to greatly increase a resistance against lateral and rotational movements of the arrowhead 12 relative to the arrow shaft 14.

The elongated arrow shaft is completed by fletching 50 extending in a conventional manner along a trailing end 52 of the shaft. Preferably, the elongated shaft 14 is approximately one and one half inches longer than a distance between a string and an arrow rest of an unillustrated bow in full draw from which the arrow 10 is to be shot. Such excess length of the arrow shaft 14 precludes engagement of the trailing edges 24 and 26 against the bow or shooter during use of the device 10. Further, should a fracturing of the arrow shaft occur proximal to the bifurcated end 36 thereof, the arrow shaft can be cut to define an orthogonal end, with a conventional arrowhead being securable to the orthogonal end to define a conventionally know arrow.

In use, the archery arrow 10 according to the present invention piercingly engages a target during both entrance and removal of the arrowhead 12 relative thereto. When the arrow 10 is utilized in the hunting of game, the leading edges 20 and 22 facilitate entrance of the arrow 10 into the animal, while both the leading and trailing edges 20–26 cooperated to produce internal lacerations within the animal subsequent to shooting thereof which significantly increases the lethality of the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery arrow comprising:

an arrowhead means for piercing a target in both forward and reverse directions, the arrowhead means comprising a planar member shaped so as to define a first leading edge and a second leading edge oriented at a first oblique angle relative to one another, a substantially rectangular upper recess extending along an upper surface thereof, and a substantially rectangular lower recess extending along a lower surface of the planar member, the recesses being coextensive relative to one another; and, an elongated arrow shaft coupled to the arrowhead means.

2. The archery arrow of claim 1, wherein the planar member is further shaped so as to define a first trailing edge and a second trailing edge oriented at a second oblique angle relative to one another, and further wherein the first oblique angle between the first leading edge and the second leading edge is substantially equal to the second oblique angle between the first trailing edge and the second trailing edge.

3. The archery arrow of claim 2, wherein the first leading edge is oriented at a third oblique angle relative to the first trailing edge, with the second leading edge being oriented at a fourth oblique angle relative to the second trailing edge, wherein the third and fourth oblique angles are substantially equal.

4. The archery arrow of claim 3, wherein the third and fourth oblique angles are substantially greater than the first and second oblique angles such that a longitudinal length of the arrowhead is equal to approximately at least two and one half times a transverse width of the arrowhead.

5. The archery arrow of claim 4, wherein the edges of the planar member are sharpened by an upper bevel extending about an upper perimeter of the planar member which intersects a lower bevel extending about a lower perimeter of the planar member.

6. The archery arrow of claim 5, wherein the planar member is shaped so as to define a straight rear edge intersecting the trailing edges, with a projecting alignment tab extending from the straight rear edge.

7. The archery arrow of claim 6, wherein the arrow shaft is shaped so as to define a bifurcated leading end having an upper furcation and a lower furcation, the furcations being coupled together by a straight rear wall including an alignment notch, the planar member being positioned between the furcations of the arrow shaft such that the projecting alignment tab of the planar member extends into the alignment notch, the upper furcation resides within the upper recess of the planar member, and the lower furcation resides within the lower recess.

8. The archery arrow of claim 7, wherein the recesses are shaped such that the perimeter edges of the recesses abuttingly engage the perimeter edges of the respective furcations.

9. The archery arrow of claim 8, wherein the planar member and the bifurcated end of the arrow shaft include mounting apertures directed therethrough; and further comprising a mounting pin directed through the arrow shaft and the planar member to couple the planar member to the arrow shaft.

10. An archery device comprising:

an arrowhead means for piercing a target in both forward and reverse directions, the arrowhead means comprising a planar member shaped so as to define a first leading edge and a second leading edge oriented at a first oblique angle relative to one another, the planar member being further shaped so as to define a first trailing edge and a second trailing edge oriented at a second oblique angle relative to one another, the planar member being still further shaped so as to define a substantially rectangular upper recess extending along an upper surface thereof, with a substantially rectangular lower recess extending along a lower surface of the planar member, the recesses being coextensive relative to one another.

11. The archery arrow of claim 10, wherein the first oblique angle between the first leading edge and the second leading edge is substantially equal to the second oblique angle between the first trailing edge and the second trailing edge.

12. The archery arrow of claim 11, wherein the first leading edge is oriented at a third oblique angle relative to the first trailing edge, with the second leading edge being oriented at a fourth oblique angle relative to the second trailing edge, wherein the third and fourth oblique angles are substantially equal.

13. The archery arrow of claim 12, wherein the third and fourth oblique angles are substantially greater than the first and second oblique angles such that a longitudinal length of the arrowhead is equal to approximately at least two and one half times a transverse width of the arrowhead.

14. The archery arrow of claim 13, wherein the edges of the planar member are sharpened by an upper bevel extending about an upper perimeter of the planar member which intersects a lower bevel extending about a lower perimeter of the planar member.

15. The archery arrow of claim 14, wherein the planar member is shaped so as to define a straight rear edge intersecting the trailing edges, with a projecting alignment tab extending from the straight rear edge.

16. An archery device comprising:

an arrowhead means for piercing a target, the arrowhead means comprising a planar member shaped so as to define a first leading edge and a second leading edge oriented at a first oblique angle relative to one another, the planar member being further shaped so as to define at least one substantially rectangular recess extending along a planar surface thereof; and an elongated arrow shaft coupled to the arrowhead means, the elongated arrow shaft being shaped so as to define a bifurcated leading end having an spaced furcations, the planar member being positioned between the furcations of the arrow shaft such that one of the furcations resides within the recess of the planar member.

17. The archery arrow of claim 16, wherein the recess is shaped such that the perimeter edges of the recess abuttingly engage the perimeter edges of the furcation.

* * * * *